US010807267B2

(12) United States Patent
Tunioli et al.

(10) Patent No.: US 10,807,267 B2
(45) Date of Patent: Oct. 20, 2020

(54) CUTTING DEVICE, IN PARTICULAR FOR CUTTING WEBS

(71) Applicant: RI-FLEX ABRASIVES S.R.L., Spilamberto (Modena) (IT)

(72) Inventors: Roberto Tunioli, Bologna (IT); Sergio Taddia, Savigno (IT)

(73) Assignee: RI-FLEX ABRASIVES S.R.L., Spilamberto (IT)

( * ) Notice: Subject to any disclaimer, the term of this patent is extended or adjusted under 35 U.S.C. 154(b) by 0 days.

(21) Appl. No.: 16/218,049

(22) Filed: Dec. 12, 2018

(65) Prior Publication Data

US 2019/0184593 A1 Jun. 20, 2019

(30) Foreign Application Priority Data

Dec. 20, 2017 (IT) ..... 102017000147535

(51) Int. Cl.
*B26D 1/08* (2006.01)
*B26D 7/00* (2006.01)
(Continued)

(52) U.S. Cl.
CPC ..... *B26D 7/22* (2013.01); *B26D 1/085* (2013.01); *B26D 5/086* (2013.01); *B26D 5/12* (2013.01);
(Continued)

(58) Field of Classification Search
CPC ..... B26D 1/085; B26D 2001/0066; B26D 2210/11; B26D 5/086; B26D 5/12;
(Continued)

(56) References Cited

U.S. PATENT DOCUMENTS 3,574,041 A 4/1971 Melle
3,939,743 A 2/1976 Coombes
(Continued)

FOREIGN PATENT DOCUMENTS

CN 105364983 3/2016
EP 1344615 9/2003

*Primary Examiner* — Stephen Choi
(74) *Attorney, Agent, or Firm* — Pearne & Gordon LLP

(57) ABSTRACT

A cutting device (1), in particular for rapidly cutting webs, including:

a support structure (2) including a fixed blade (3),
a carriage (4) movable along a movement direction (X),
a mobile blade (5) mounted on the carriage (4),
a guide (7), associated to the support structure (2), on which the carriage (4) is slidable along the movement direction (X);
a sliding sleeve (11), interposed between the carriage (4) and the guide (7) concentrically to the guide (7);
seals (8, 10) interposed between the guide (7) and the carriage (4) so as to define a chamber (9), concentric to the guide (7) and containing the sleeve (11);
motor (6) configured to move the carriage (4) according to an alternating movement along the movement direction (X) between a non-operating position and an operating position, in which the mobile blade (5) partially superposes the fixed blade (3) so as to carry out the cutting of a web;
supply (15) for supplying air to the chamber (9) so as to maintain it at a greater pressure with respect to the surrounding environment.

10 Claims, 4 Drawing Sheets

(51) Int. Cl.

| | |
|---|---|
| ***B26D 7/22*** | (2006.01) |
| ***B26D 7/18*** | (2006.01) |
| ***B26D 5/12*** | (2006.01) |
| ***B26D 5/16*** | (2006.01) |
| ***B26D 5/08*** | (2006.01) |
| *B26D 1/00* | (2006.01) |

(52) U.S. Cl.
CPC ..... *B26D 5/16* (2013.01); *B26D 7/0006* (2013.01); *B26D 7/18* (2013.01); *B26D 7/1854* (2013.01); *B26D 2001/0066* (2013.01); *B26D 2210/11* (2013.01)

(58) Field of Classification Search
CPC ..... B26D 5/16; B26D 7/0006; B26D 7/18; B26D 7/1854; B26D 7/22
See application file for complete search history.

(56) References Cited

U.S. PATENT DOCUMENTS

| | | | | |
|---|---|---|---|---|
| 4,220,063 | A * | 9/1980 | Kiemer | B23D 15/06 83/635 |
| 2012/0048081 | A1 * | 3/2012 | Tanaka | B26D 1/205 83/34 |

* cited by examiner

CUTTING DEVICE, IN PARTICULAR FOR CUTTING WEBS

The present invention relates to a cutting device, in particular for the scissor-type cutting of webs.

In the following description reference will be made, by way of example, to a cutting device for the scissor-type cutting of webs for the sector of machines that perform quick cuts of abrasive material into strips, but without reducing the generality of the invention.

The strips obtained with the cutting device according to the present invention are used, for example, for creating abrasive discs for cutting tools.

The webs of abrasive material are generally supplied in reels that are then unwound gradually for being fed to the cutting device, which then cuts the webs in a scissor-type way.

Inevitably, the cutting of strips of abrasive material produces a substantial amount of dust and scraps which often obstruct the cutting device, which requires continuous maintenance and cleaning or even replacement.

Known systems generally envisage a sliding guide system which cyclically moves a blade towards the respective fixed blade for performing the scissor-type cutting of the web in synchronised advancement with the longitudinal dimension of the strip to be obtained.

Despite the guide being lubricated with greases and/or oils and provided with external gaskets, the dirt deriving from the cutting operation passes through the gaskets and ends up being deposited in the sliding zone, often causing jamming and the breaking of the sleeve itself.

Thus, in known systems, the production process is often interrupted for maintenance operations or the replacement of degraded components of the cutting device, with consequent increases in production costs and times.

Furthermore, in systems which are typically known for reducing the entry of dirt to a minimum, the sliding system is made with a minimum section in order to have an exposed external surface area which is reduced to the bare minimum in order to minimise the amount of dust that can accumulate and penetrate inside. However, this implies a reduction in the structural rigidity of the cutting device which may be subject to breakages or misalignments that can interfere with the correct cutting of the web.

In this context, the technical task underpinning the present invention is to provide a cutting device, in particular for the scissor-type cutting of webs, that obviates one or more drawbacks of the prior art as cited above.

In particular, it is an object of the present invention to provide a cutting device, in particular for the scissor-type cutting of webs, which is able to increase the durability of the cutting devices, improving the efficiency of the production process.

A further object of the present invention is to provide a cutting device, in particular for the scissor-type cutting of webs, which is structurally more rigid and reliable.

The set technical task and specified aims are substantially attained by a cutting device, in particular for the scissor-type cutting of webs, comprising the technical characteristics set out in one or more of the appended claims.

Further characteristics and advantages of the present invention will become clearer from the indicative, and therefore non-limiting, description of a preferred but not exclusive embodiment of a cutting device, in particular for the scissor-type cutting of webs, as illustrated in the attached drawings, in which.

Figure 1:
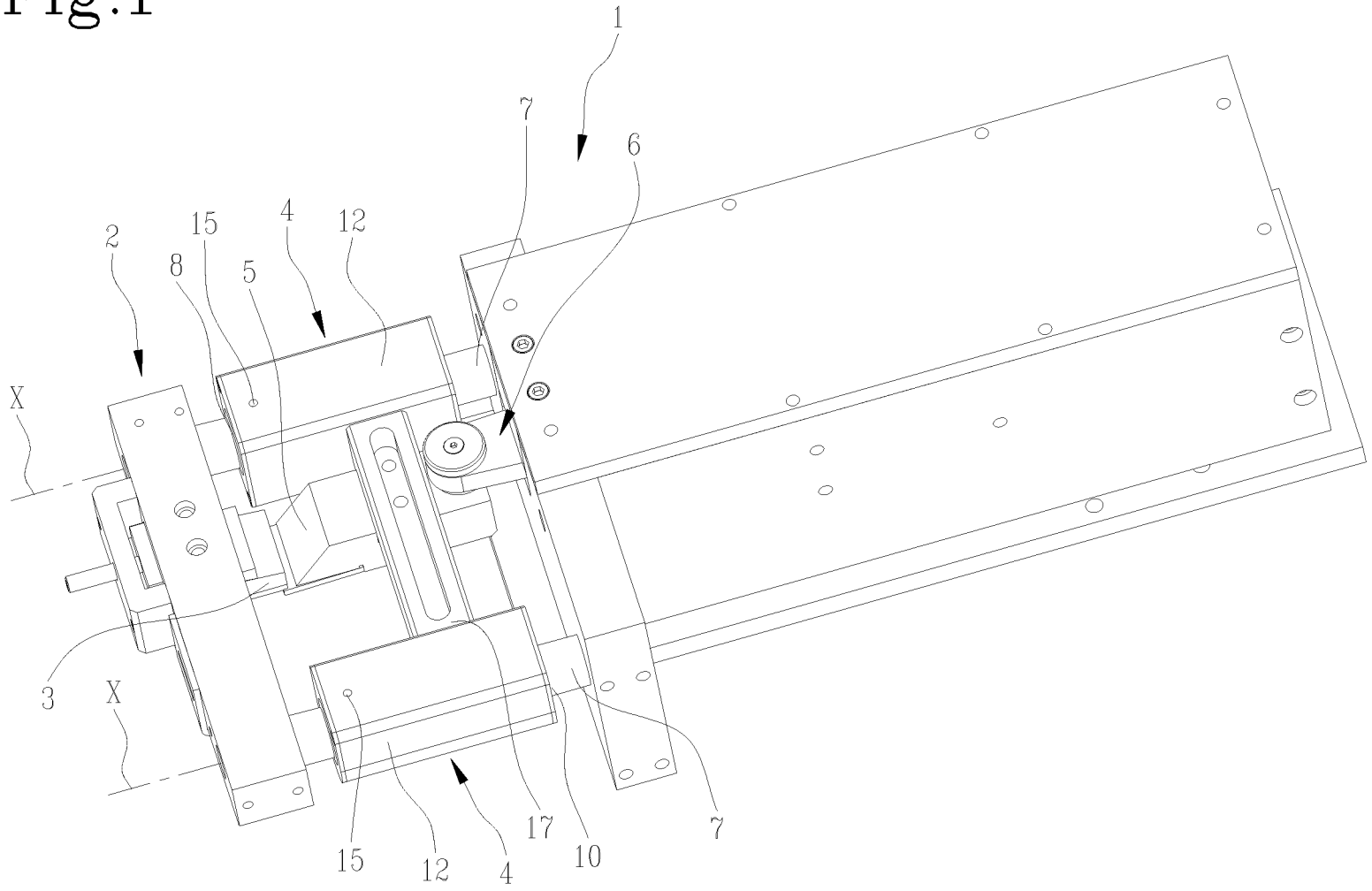
FIG. 1 is a schematic isometric view of a cutting device according to the present invention.
Figure 2:
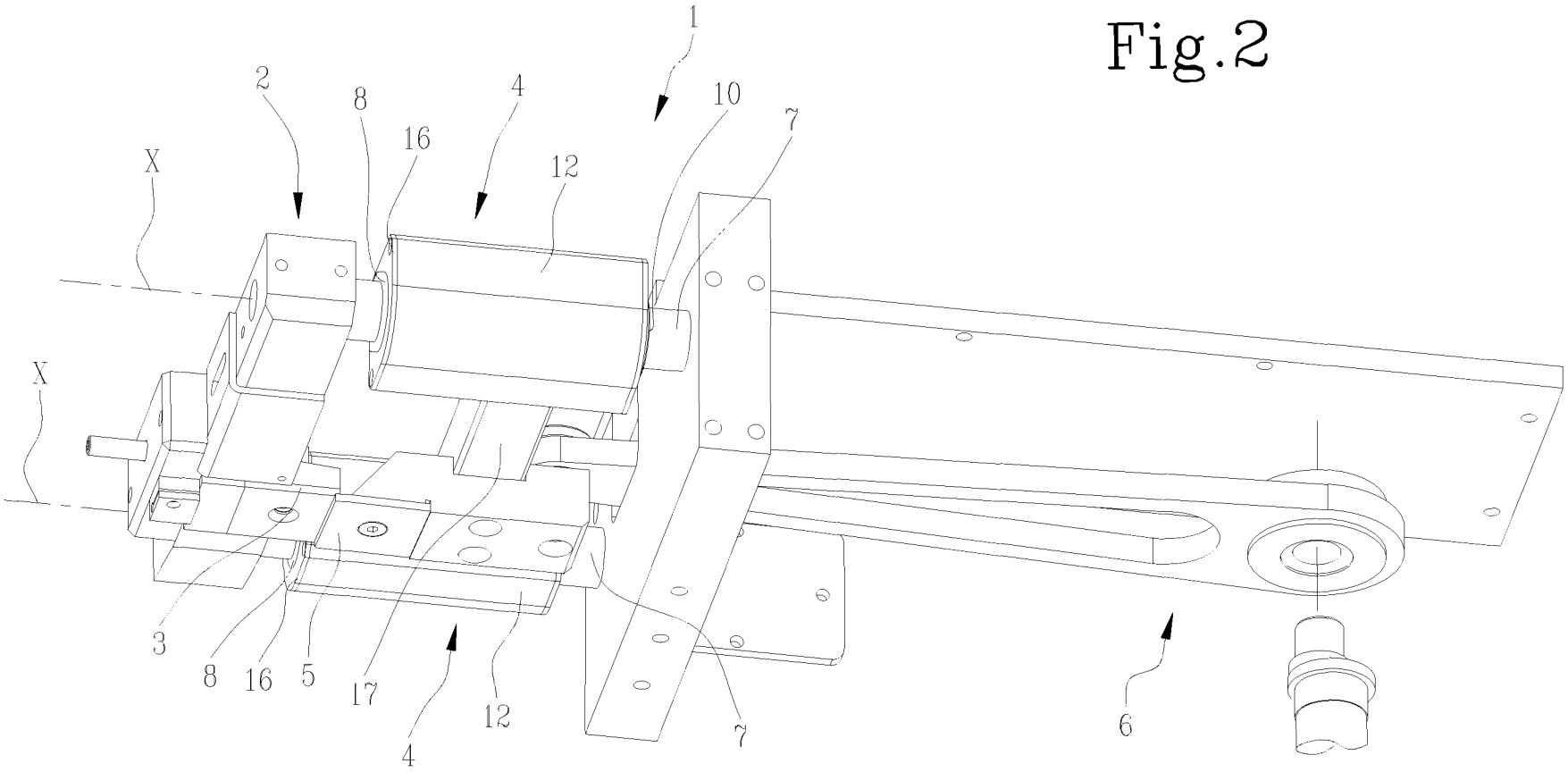
FIG. 2 is a partially exploded view, in which some parts have been hidden to better highlight others, of the device of FIG. 1 seen from below.
Figure 3:
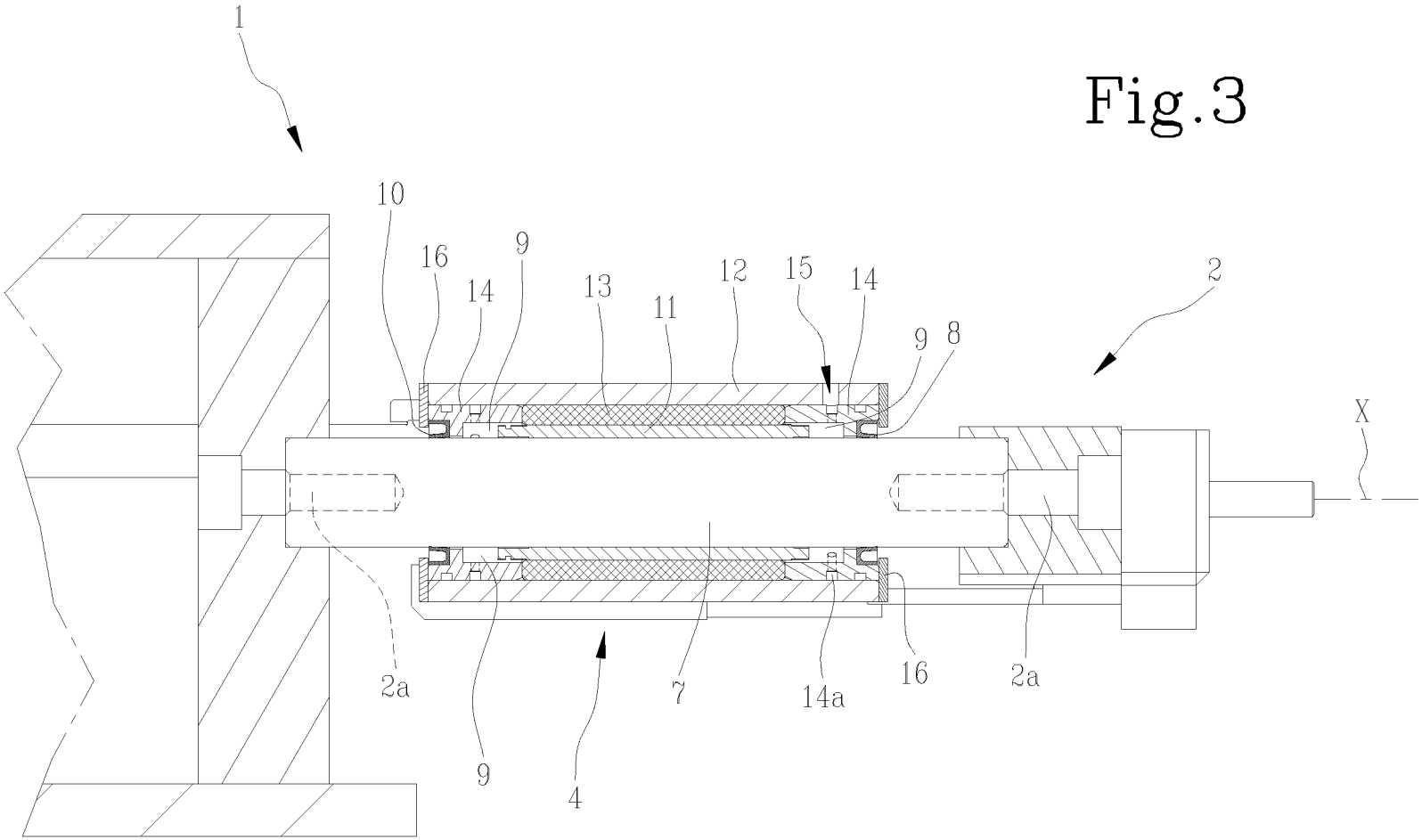
FIG. 3 is a schematic section of the device of FIG. 1 along a vertical plane passing through the sliding axis of the device guide.
Figure 4:
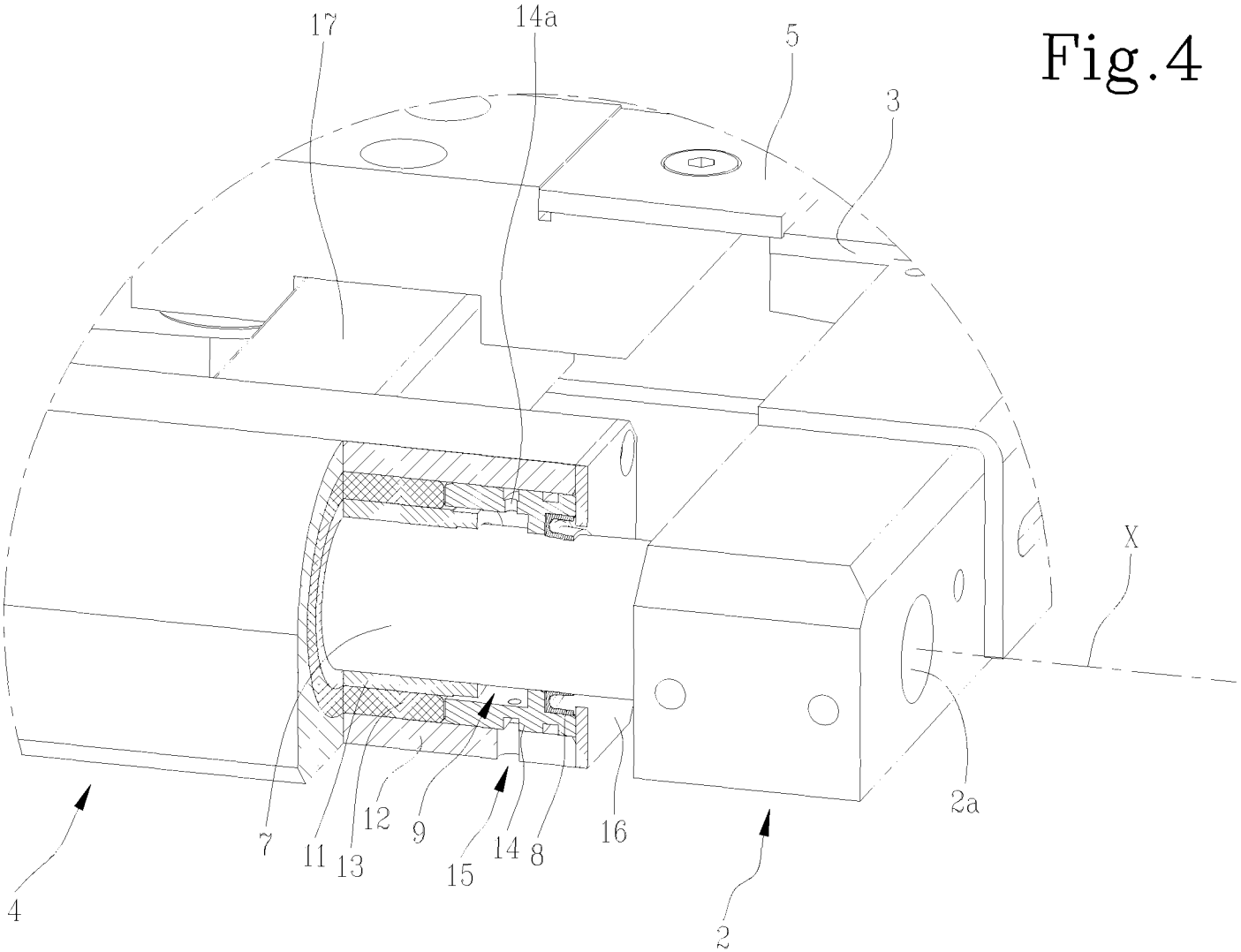
FIG. 4 is an enlarged and partially sectioned schematic view of a structural detail of the device of FIG. 1, at the sliding coupling zone.

The cutting device according to the present invention is particularly indicated for cutting continuous webs into sections having a predetermined length. Substantially, the continuous web is gradually fed to the cutting device which then cuts it into sections of a predetermined length.

The device 1 according to the present invention comprises a support structure 2, provided with a fixed blade 3. The support structure 2 may be connected to an overall support frame of the device 1, or to another structural part of the device 1.

The device according to the present invention further comprises a carriage 4, movable with alternating motion along a movement direction X. The carriage 4 carries a mobile blade 5, configured and positioned to perform a scissor-type cut with the fixed blade 3. A motor means 6 is configured to move the carriage 4 according to an alternating movement along the movement direction X between a non-operating position, in which they are distanced from each other, and an operating position, in which the mobile blade 5 partially superposes the fixed blade 3 so as to carry out the cutting of a web.

The blades 3,5 substantially open and close cyclically, at a predetermined working frequency. The web is fed to the blades 3,5 along a direction which is perpendicular to the movement direction X, in a continuous manner during the opening and closing cycle of the blades 3,5. At each closure of the blades, the web is cut so as to separate a section, i.e. end portion of a predetermined length. The length of the sections can be adjusted by varying the supply speed of the web and/or the working frequency of the blades 3,5.

A guide 7 is associated with the support structure 2. Preferably, the guide 7 is in the form of a cylindrical stem. The carriage 4 is slidable on such guide 7 along the movement direction X. A sliding sleeve 11 is interposed between the carriage 4 and the guide 7. In particular, the sliding sleeve 11 is external and concentric to the guide 7.

The sliding sleeve 11 is arranged in contact with both the carriage 4 and the guide 7, and has the function of reducing the friction between the carriage 4 and the guide 7. In a possible embodiment, the sliding sleeve 11 comprises a rolling support member, e.g. a roller cage/ball cage, interposed between the guide 7 and the carriage 4 so as to define a sliding coupling.

In the represented embodiment, the carriage 4 comprises a box body 12 fitted onto the guide 7. In other words the guide 7 is inserted inside the sliding sleeve 11, which is closed into the box body 12. Between the sliding sleeve 11 and the box body 12 a support bushing 13 may be interposed, which substantially defines a sliding surface for the sleeve 11. The support bushing is kept in position by means of two blocking bushings 14, arranged at the ends of the support bushing 13.

Seal means 8,10 are interposed between the guide 7 and the carriage 4, so as to define a chamber 9, concentric to the guide 7 and containing the sleeve 11. Such seal means 8,10 comprise for example a pair of seal rings, located on opposite sides of the sleeve 11 and concentric to the guide 7. The seal rings 8,10 can be housed in respective seats afforded in the carriage 4.

Substantially, between the guide surface 7, the seal rings 8,10 sealingly slidable on the guide 7, and an inner surface of the carriage 4 a closed chamber is defined, inside which the sliding sleeve 11 is located. The chamber 9 has an annular conformation and closes the entire sliding coupling zone between the guide 7 and the sleeve 11.

In the represented embodiment, the blocking bushes 14 delimit, at least partially, a seat for the seal rings 8,10. The carriage 4 comprises two closing flanges 16, arranged in contact with the seal rings 8,10 and fixed to the box body 12 to retain the blocking bushings 14 and the seal rings 8, 10 themselves.

The device according to the present invention comprises supply means 14*a*,15, provided for supplying air to the chamber 9 so as to maintain it at a greater pressure with respect to the surrounding environment.

Thanks to the presence of the chamber 9 and the supply means 14*a*,15 that maintain the chamber 9 at a greater pressure with respect to the surrounding environment, it is possible to effectively isolate the sliding coupling zone between the carriage 4 and the guide 7. In fact, the pressurised air present inside the chamber 9 produces a flow that filters between the surface of the guide 7 and the surface of the seal rings 8,10 at the outlet from the chamber 9. Such flow prevents the scraps produced by cutting from slipping between the surface of the guide 7 and the seal rings 8,10, so that the scraps cannot contaminate the coupling zone between the sleeve 11 and the guide 7. The sleeve 11, especially if in the form of a ball cage, is notably less subject to wear with respect to what happens in devices currently available, as it works inside the chamber 9 which, thanks to the supply of air that maintains the pressure greater than ambient pressure, repels the dirt to the outside.

Furthermore, the cleaning of the chamber 9, due to the pressure which is greater than ambient pressure, allows the section of the guide 7 to be increased, i.e. the diameter to be increased. This is because, as already mentioned, the pressurised air present inside the chamber 9 produces a flow that filters between the surface of the guide 7 and the surface of the seal rings 8,10 at the outlet from the chamber 9. Such flow prevents the scraps produced by cutting from slipping between the surface of the guide 7 and the seal rings 8,10, so that also the seal rings 8,10, even if they are made with a larger diameter, are less subject to wear with respect to what happens in the currently available devices.

The possibility to realise guides 7 with a larger section, and therefore greater rigidity, allows the interference between the fixed blade 3 and the mobile blade 5 necessary for a precise cut to be reduced. This leads to greater durability of the blades and a consistent reduction in impacts and vibrations produced at the time of cutting.

The supply means for supplying air to the chamber 9 comprises a source of pressurised fluid, not shown, which is connected to the chamber 9 by means of a conduit 15 realised in the carriage 4, in particular realised in the box body 12. For example, the conduit 15 may be defined by a hole. The conduit 15 may also be arranged in communication with one or more openings 14*a* afforded through the blocking bush 14, if this is provided. Such openings 14*a*, in turn, are in communication with the chamber 9. The pressurised fluid may come from a compressed air system, from a tank or from a compressor with which the cutting device according to the present invention may be provided.

In the represented embodiment, which is preferred but not exclusive, the cutting device according to the present invention comprises a pair of guides 7, in the form of parallel cylindrical stems. Each guide is fixed, at the ends thereof, to the support structure 2, e.g. through screws 2*a*.

In the represented embodiment, the carriage 4 comprises two box bodies 12, each of which is slidable on a respective guide 7 along the movement direction X. The two box bodies 12 are connected to each other rigidly by a support element 17 on which the mobile blade 5 is mounted.

The structure of the carriage 4 described above is particularly rigid, and contributes to making the coupling between the fixed blade 3 and the mobile blade 5 particularly precise, so as to reduce the wear thereof and simultaneously the impacts and vibrations of the cutting device.

The invention claimed is:

1. A cutting device (1), in particular for rapidly cutting webs, the cutting device (1) comprising:

a support structure (2) comprising a fixed blade (3), a carriage (4) movable along a movement direction (X), a mobile blade (5) mounted on the carriage (4), a guide (7), connected to the support structure (2), the carriage (4) being slidable on the guide (7) along the movement direction (X);

a sliding sleeve (11), interposed between the carriage (4) and the guide (7) concentrically to the guide (7);

seal means (8, 10) interposed between the guide (7) and the carriage (4) in such a way as to define a chamber (9) which is concentric to the guide (7) and which contains the sleeve (11);

motor means (6) configured to move the carriage (4) according to an alternating movement along the movement direction (X) between a non-operating position and an operating position, in which the mobile blade (5) partially superposes the fixed blade (3) so as to carry out the cutting of a web;

characterised in that the cutting device (1) comprises supply means (15) for supplying air to the chamber (9) so as to maintain the chamber (9) at a greater pressure with respect to the surrounding environment, wherein the seal means (8, 10) comprise a pair of seals, and wherein pressurized air within the chamber (9) will flow out of the chamber (9) between the surface of the guide (7) and the surface of one or more of the seals.

2. The cutting device according to claim 1, wherein the supply means (15) comprises a conduit (15) extending through the carriage (4).

3. The cutting device (1) according to claim 2, wherein the carriage (4) comprises a box body (12) which is slidable on the guide (7), the conduit (15) extending through the box body (12).

4. The cutting device according to claim 3, wherein the box body (12) comprises: a support bushing (13), the sleeve (11) being slidable inside the support bushing (13); two blocking bushings (14), arranged at the ends of the support bushing (13), for defining the position of the support bushing (13) with respect to the box body (12).

5. The cutting device according to claim 4, wherein the box body (12) comprises two closing flanges (16), configured to retain the seal means (8, 10) and the blocking bushings (14).

6. The cutting device (1) according to claim 1, wherein the sleeve (11) comprises a rolling support member.

7. The cutting device (1) according to claim 1, wherein each of the seals is concentric to the guide (7).

8. The cutting device (1) according to claim 1, comprising a second guide (7) so that the cutting device (1) has a pair of guides (7), the pair of guides (7) extending parallel to one another, wherein: the carriage (4) comprises two box bodies (12), each of which is slidable on a guide (7); the two box bodies (12) are connected to one another by means of a support element (17) on which the blade (5) is mounted.

9. The cutting device (1) according to claim 8, wherein each of the guides (7) has a longitudinal axis, the pair of longitudinal axes being parallel and defining a first plane, the blade (5) having a cutting edge which defines a line which is parallel to said first plane.

10. The cutting device (1) according to claim 1, wherein the motor means (6) comprises a cam mechanism connected to a motor.

* * * * *